US005316209A

United States Patent [19]

Tomisawa et al.

[11] Patent Number: 5,316,209

[45] Date of Patent: May 31, 1994

[54] EASY OPENING FILM PACKAGE AND A METHOD OF PREPARING THE SAME

[75] Inventors: Maya Tomisawa; Shuji Higashi, both of Saku; Koji Sasagawa, Chiba; Tatsuo Fujii, Saku, all of Japan

[73] Assignee: TDK Corporation, Tokyo, Japan

[21] Appl. No.: 983,406

[22] Filed: Nov. 30, 1992

[30] Foreign Application Priority Data

Nov. 30, 1991 [JP] Japan ..... 3-342147

[51] Int. Cl.[5] ..... B65D 27/00; B65D 27/34

[52] U.S. Cl. ..... 229/87.05; 206/459.5; 229/203; 229/923

[58] Field of Search ..... 229/87.05, 87.19, 203, 229/923; 206/457, 459.5, 497

[56] References Cited

U.S. PATENT DOCUMENTS

| | | | |
|---|---|---|---|
| 2,294,690 | 9/1942 | Perry | 229/923 |
| 2,330,691 | 9/1943 | Darrow | 229/203 |
| 2,651,131 | 9/1953 | Long et al. | 206/457 |
| 2,808,194 | 10/1957 | Dols | 206/457 |
| 3,027,060 | 3/1962 | Beder | 229/923 |
| 4,658,963 | 4/1987 | Jud | 229/87.05 |
| 4,726,473 | 2/1988 | Sato et al. | 229/87.05 |
| 4,859,514 | 8/1989 | Friedrich et al. . | |
| 5,011,014 | 4/1991 | Borck et al. | 229/87.05 |
| 5,129,518 | 7/1992 | Tanaka et al. | 229/87.05 |
| 5,184,771 | 2/1993 | Jud et al. | 229/87.05 |

FOREIGN PATENT DOCUMENTS 2239854 7/1991 United Kingdom .

*Primary Examiner*—Gary E. Elkins

*Attorney, Agent, or Firm*—Oblon, Spivak, McClelland, Maier & Neustadt

[57] ABSTRACT

An easy opening film package for wrapping cubic or rectangular shaped articles is prepared from a film having a printed portion containing ink and a compatible thermoplastic resin on one surface of the film. The film is wrapped around the article and heat sealed in the area of overlap of the film ends. The printed portion extends to the ends of the film and across the film over a width substantially coextensive with the width of the face of the article on which the seal is to be located.

1 Claim, 4 Drawing Sheets

EASY OPENING FILM PACKAGE AND A METHOD OF PREPARING THE SAME

The present relates to a package of film which improves an easy opening characteristic without using a tear tape (cut tape) and a method of forming the same.

Various kinds of package have been performed with use of suitable materials and containers in order to maintain good value and conditions of articles during transportation and storage of them. Generally, packaging with use of a films is suitable because the film are thin and the contents can be seen from outside when a transparent film is used. For containers for receiving tape cassettes for audio or video, cigarette cases, containers for caramels and so on, a non-stretched film or a stretched film such as polypropylene, polyvinyl chloride or the like has been used.

In a conventional film package, for instance, a film 10 to be used for packaging is prepared by cutting away a continuous film 14 having a printed portion 12 (indicated by hatched portion) at broken line portions 16 (16*a*, 16*b*) as shown in FIG. 4. In FIG. 4, numeral 18 (18*a*, 18*b*) designate transparent portions corresponding to sealing zones to be located at the main body portion of an articles to be packaged, and numeral 20 (20*a*, 20*b*) designate transparent portions corresponding to sealing zones in a side sealed package, which are located at both end surfaces.

A side sealed package 30 is prepared as follows. A single sheet of film 1 is bent along the outer configuration of a rectangular prism-like casing so that transparent portions 18, 20 are overlapped at the main body portion 22 and both side surface portions 24 (only right side surface can be seen), and then, the overlapping portions 18, 20 are bonded by applying heat to thereby form sealing zones 26, 28. In the specification, a film package according to the present invention is referred to as a side sealed type package since packaging a container of rectangular prism like candies is utilized in a part of the film package.

Generally, such side sealed type package 30 is provided with a tear tape 32, which is used for opening the package, near an end of the package 30. The tear tape 32 is bonded inside of and perpendicular to the sealing zone 26 having a large bonding strength which is located at the main body portion 22. When the tear tape 32 is bonded to the inside of the sealing zone 26, heat is applied to melt paste coated on a surface of the tear tape 32 so as to be bonded to the film 10.

FIG. 6 shows a case that no tear tape is used. In this case, two cut portions 38 (38*a*, 38*b*) are formed in a parallel relation in the sealing zone 36 of a package 34. Then, the package can be opened by pulling a film piece 42 between the two cut portions 38 to tear the film 10. The positions of the sealing zones, the tear tape, the cut portions and so on can be changed as desired.

However, the conventional package had disadvantage as follows. In a package provided with the tear tape 32, there is a case that only the portion of the tear tape 32 was cut away at the time of opening the package as shown in FIG. 7 because a resinous material such as polyester which is stronger than the film 10 is usually used for the tear tape 32. Accordingly, although an end portion 44 of the package 30 can be easily removed from the casing 46, it is troublesome to remove the main portion 48 of the film package. In particular, in a case that a stretched film is used and the film is heat-shrinked after packaging so that the entirety of the film is brought to close-contact with the casing, the contacting strength is large and accordingly, it is difficult to remove the film from the package. In this case, the film is cut with use of a knife or the like and the film has to be teared by fingers.

Since the tear tape 32 has not heat-shrinking property, there causes wrinkles in the films 10 at or near the location of the tear tape 32 whereby the appearance of the film package is deteriorated.

When no tear tape is used, no wrinkles are naturally take place. However, since the bonding strength of the sealing zones 36 is large, a small portion 50 of the film package neighboring a film piece 42 is teared off at the time of opening as shown in FIG. 8, and it takes much time to remove the entire portion 34 of the film.

It is an object of the present invention to provide a film package which has a requisite sealing function while it can be easily opened, and which has an excellent appearance and a low manufacturing cost, and a method of forming such film package.

In accordance with the present invention, there is provided an easy opening film package formed by lapping a cubic or rectangular prism-like article with a film having a printed portion on pt least one of the surfaces wherein the film has in the area along its end portions sealing zones which are overlapped and bonded by heat at the main body portion of the article, said film package being characterized in that a print layer comprising ink and resin which is compatible with the raw resin of the film is located in the entire region in the sealing zones of the film at the main body portion of the article.

Further, in accordance with the present invention, there is provided a method of forming an easy opening film package as defined above, which is characterized by forming a print on portions of a film at the position corresponding to sealing zones to be located at the main body portion of the article with use of ink incorporated with resin which is compatible with the raw resin of the film; opposing the rear side of one portion of the film to the front side of the other portion; overlapping the both portions, and heat bonding the overlapping portions as the sealing zones.

Preferred embodiments of the present invention will be described with reference to the drawings.

Figure 1:
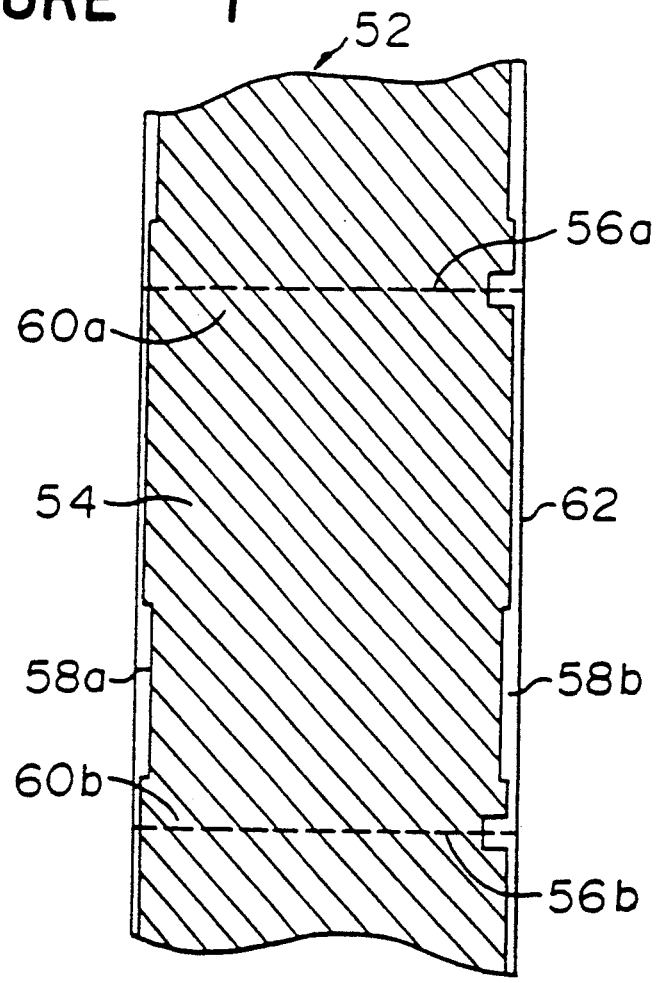
FIG. 1 is a plane view of a part of a continuous film used for the film package according to the present invention.

FIG. 1 is a plane view showing a part of a continuous film for wrapping a package in accordance with the present invention. In FIG. 1, reference numeral 52 designates a continuous film made of polypropylene, numeral 54 designates a printed portion applied to the rear surface of the continuous film 52, numeral 56 (56*a*, 56*b*) designates lines indicating portions to be cut to form a unit film sheet, and numeral 58 (58*a*, 58*b*) designates transparent portions corresponding to sealing zones of a caramel type package, the sealing zones being formed at both side surface portion of the package.

Ink for printing on the continuous film 52 is incorporated with resin such as polyamide resin which is compatible with polypropylene which is the raw resin of the film 52. An amount of the resin to be added in the ink may be changed to adjust a heat bonding strength. The ink incorporated with the resin being compatible with the film 52 may be used when printing is carried out at the outermost surface of the continuous film 52.

The both side areas along the cut lines 56 (56*a*, 56*b*) of the continuous film 52 for forming a unit film sheet are respectively portions 60 (60*a*, 60*b*) corresponding to sealing zones to be located at the main body of a cubic or rectangular prism-like particle. Further, printing is applied in the entire area of the portions 60 with use of ink in which resin compatible with the raw resin of the film 52 is incorporated. Thus, by forming a print on the portions 60 corresponding to the sealing zones so as to be extended to other portions, printing operations can be easy because the printing is carried out without any limitation by the sealing zones.

Figure 2:
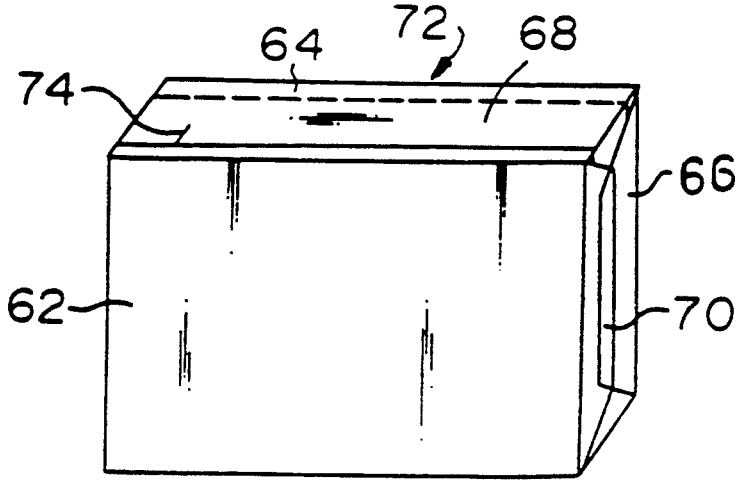
FIG. 2 is a perspective view of an embodiment of the film package according to the present invention.

A unit film sheet 62 cut from the continuous film 52 is used. The unit film sheet 62 is bent so as to meet the outer configuration of a rectangular prism-like casing whereby overlapping portions 60, 58 are provided at the the main body portion 64 and both side surface portions 66 of the casing, as shown in FIG. 2. The overlapping portions are bonded by applying heat to thereby form sealing zones 68, 70. Thus, a side sealed type package 72 is completed. In the wrapping operations, when the rear side surface of one portion 60*a* of the film 62 is opposed to the front side surface of the other portion 60*b* and overlapped one with other in order to form the sealing zone at the main body portion 64 of the casing, bonding by heat can be easy because a printing layer comprising ink incorporated with resin compatible with the raw resin of the film 62 is located between the rear and front side surfaces of the portions 60.

Thus, the bonding of the portions 60 of the film 62 to form the sealing zone 68 by means of the resin added in the ink provides a smaller bonding strength than a case that the film portions are directly contact with each other. Accordingly, the bonding strength can be weakened while a requisite sealing function and an easy opening characteristic are provided by suitably selecting an amount of resin to be added to the ink so as not to cause the separation of the sealing zone 68 under natural circumstances during the transportation of the particle. In this case, it is preferable to adjust the bonding strength so that the amount of the resin to be added to the ink is in a range of 40–100 part by weight to 100 part by weight of pigment.

TABLE 1

| | Quantity of resin Large ← → Small | | | | |
|---|---|---|---|---|---|
| Pigment | 100 | 100 | 100 | 100 | 100 |
| Resin | 150 | 100 | 60 | 40 | 20 |
| Bonding strength | ◎ | ∘ | ∘ | Δ | X |
| Easy opening characteristic | X | Δ | ◎ | ◎ | — |
| Hiding characteristic | X | Δ | ∘ | ∘ | ◎ |

◎: Very excellent
∘: Excellent
Δ: Good
X: No good

As is clear from Table 1, a sufficient bonding strength can not be obtained when the resin quantity is less than 40 part by weight, and there takes place separation at the main body portion in environment tests. On the other hand, when the resin quantity exceeds 100 part by weight, the bonding strength is too large and the easy opening characteristic becomes inferior. Further, the hiding characteristic to the casing also becomes inferior whereby the appearance may be damaged.

If an excellent easy opening characteristic can be provided, the tear tape need not to be provided, and there is no troubles in arranging the tear tape and efficiency of production can be increased.

Figure 3:
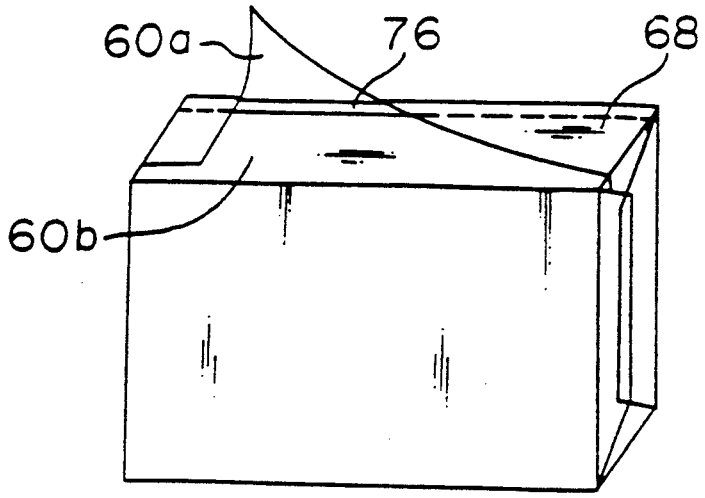
FIG. 3 is a perspective view showing a state of opening of the film package shown in FIG. 2.
Figure 4:
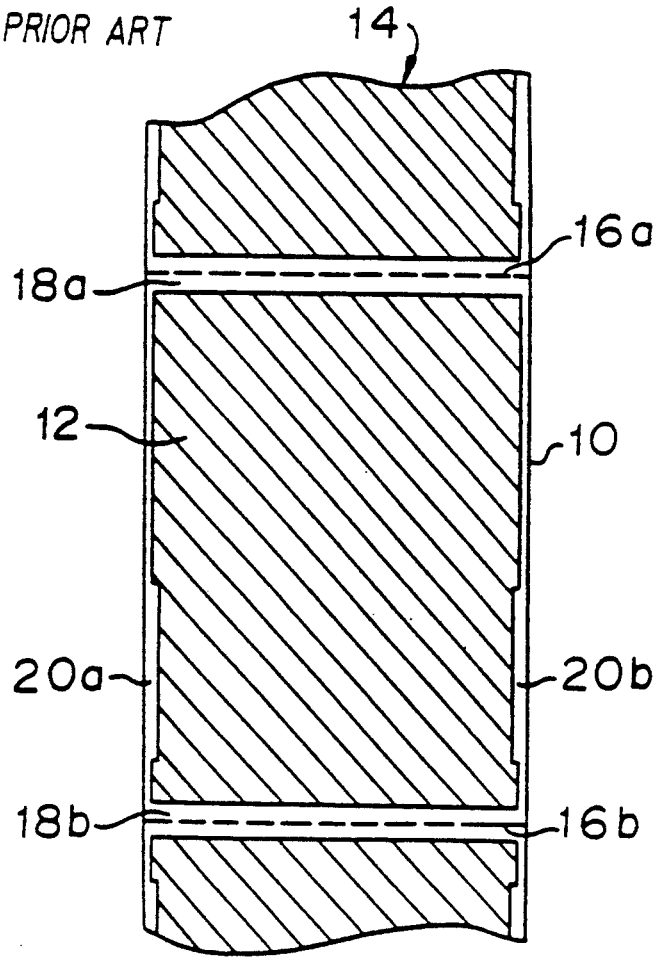
FIGURE 4 PRIOR ART
FIG. 4 is a plane view of a part of a conventional continuous film for a film package.
Figure 5:
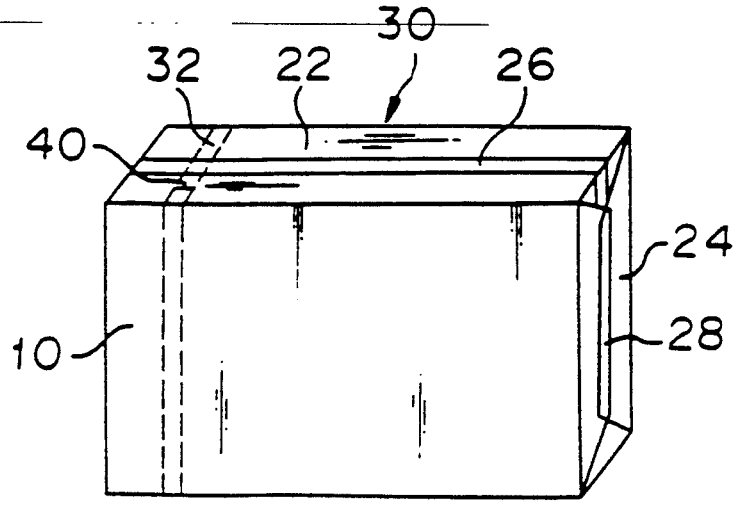
FIGURE 5 PRIOR ART
FIG. 5 is a perspective view of a conventional film package.
Figure 6:
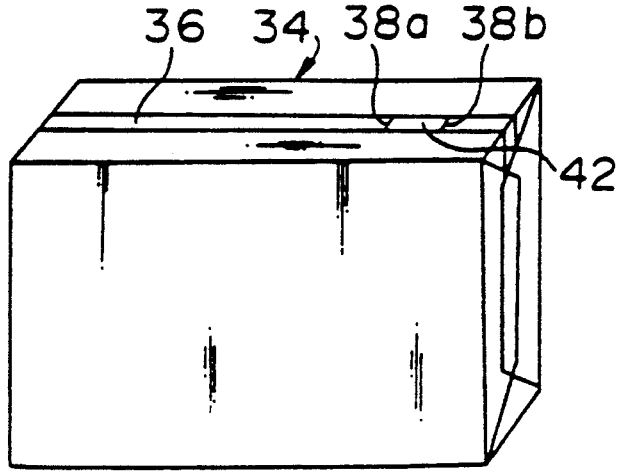
FIGURE 6 PRIOR ART
FIG. 6 is a perspective view showing another conventional film package.
Figure 7:
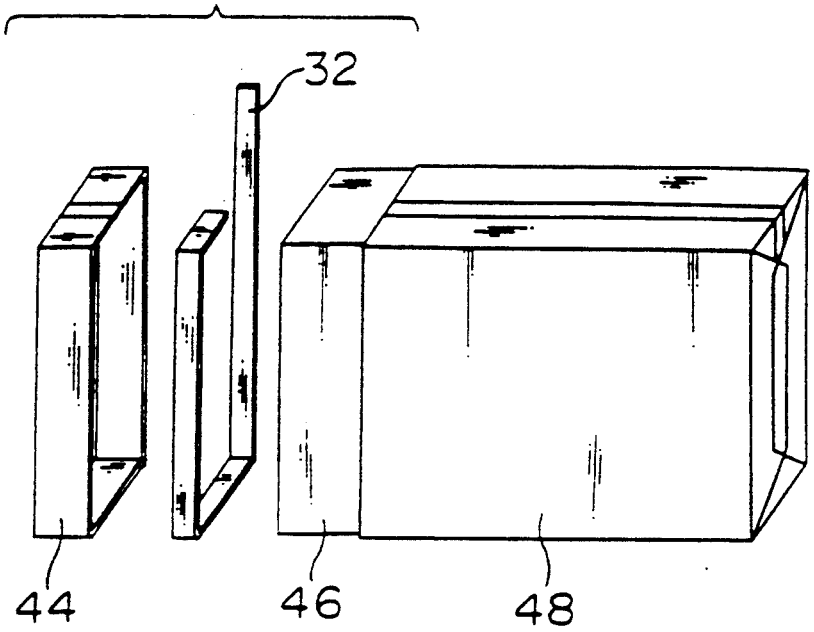
FIGURE 7 PRIOR ART
FIG. 7 is a perspective view showing a state of opening of the film package with a tear tape shown in FIG. 5.
Figure 8:
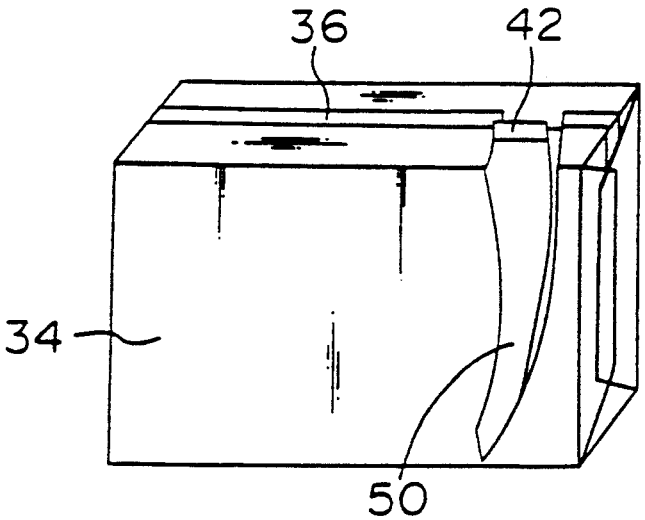
FIGURE 8 PRIOR ART
FIG. 8 is a perspective view showing a state of opening of the film package shown in FIG. 6.

When the sealed zones are opened, cut portion 74 which has been previously formed at a film portion 60*a* which is located in an overlapping state at the upper side of the sealing zone 68 is utilized. A portion of the film near the cut portion 74 is peeled by a nail. Then, the upper film portion 60*a* is well peeled off from the lower film portion 60*b* along the sealing zone 68 as shown in FIG. 3. By further pulling the film portion near the cut portion 74, the entirety of the packaging film 72 can be easily removed from the casing 76. It is possible to partly project a portion of the film to be pulled instead of forming the cut portion 74. In the above-mentioned embodiment, a casing is wrapped by a film wherein printing is formed only in the back surface. However, it is possible to use a film wherein printing is formed in the both surfaces except for a front surface portion corresponding to the sealing zone to be located at the main body portion of the casing.

Thus, in accordance with the present invention, a printing layer comprising ink and resin compatible with the raw resin of a film is located at the entire region in overlapping film parts, as sealing zones, in the main body portion of a casing, whereby the overlapping film portions as the sealing zones are bonded with each other by means of the resin added in the ink. By suitably selecting an amount of the resin to be added to weaken the bonding strength, it is possible to increase the easy opening characteristic while a requisite sealing function can be provided. It is unnecessary to use a tear tape, and a package of film having an excellent appearance can be obtained at a low cost.

Further, in accordance with the present invention, printing can be easily conducted without suffering any limitation by the sealing zones when the printing is conducted with use of ink incorporated with resin compatible with the raw resin of a film to the entire region of film portions corresponding to the sealing zones located at the main body portion of a casing. Further, when the film portions are overlapped at the forming of the sealing zones, the bonding of the film portions by heating can be easy. Since no tear tape is used, a step of providing the tear tape is unnecessary and productivity can be improved. Accordingly, a package of film can be manufactured at a low cost.

We claim:

1. An easy opening film package formed by lapping a cubic or rectangular prism article with a resin film having first and second surfaces, and opposing first and second ends, and having a printed portion on at least one of the surfaces, said lapping resulting in an overlap of said first surface over said second surface across a face of said rectangular prism, the area of said overlap across said face defining a sealing zone wherein the film surfaces at said sealing zone are bonded together by heat, said film package being characterized in that said printed portion comprising ink and a resin compatible with the resin film covers the entire resin film printed surface in the sealing zone of the film, said compatible resin comprising a thermoplastic resin in an amount such that a bond formed in the sealing zone by the application of heat to said print layer is of sufficient strength to prevent separation of said thermoplastic film at said sealing zone during normal handling but whose bond strength is less than the bond strength which would otherwise be obtained by heat sealing said resin film to itself.

* * * * *